US005722276A

United States Patent [19]

Aigner et al.

[11] Patent Number: 5,722,276

[45] Date of Patent: Mar. 3, 1998

[54] METHOD FOR ATTACHING FACEPLATE MOUNTING TABS TO A MORTISE LOCK HOUSING AND TABS AND HOUSINGS ADAPTED FOR THAT METHOD

[75] Inventors: Helmut R. Aigner, Colorado Springs, Colo.; Steven D. Small, San Rafael, Calif.

[73] Assignee: Schlage Lock Company, San Francisco, Calif.

[21] Appl. No.: 791,026

[22] Filed: Jan. 27, 1997

Related U.S. Application Data

[63] Continuation of Ser. No. 507,734, Aug. 3, 1995, abandoned.

[51] Int. Cl.[6] ..... E05B 9/08

[52] U.S. Cl. ..... 70/451; 70/448; 292/337

[58] Field of Search ..... 70/448, 450, 451, 70/461, 466; 292/337, DIG. 53–55

[56] References Cited

U.S. PATENT DOCUMENTS

| | | | |
|---|---|---|---|
| 333,434 | 12/1885 | Voll . | |
| 365,152 | 6/1887 | Simson | 70/448 |
| 396,915 | 1/1889 | Burgess . | |
| 416,248 | 12/1889 | Arens | 70/450 |
| 425,237 | 4/1890 | Morton | 70/450 |
| 446,246 | 2/1891 | Beebe . | |
| 612,397 | 10/1898 | Burgess | 70/448 |
| 623,296 | 4/1899 | Voight | 70/448 |
| 1,719,282 | 7/1929 | Wilson . | |
| 2,304,612 | 12/1942 | Voight | 70/448 |
| 2,413,732 | 1/1947 | Schlage | 292/337 |
| 2,497,189 | 2/1950 | Shaffer | 70/450 |
| 2,656,207 | 10/1953 | Russell et al. | 292/169 |
| 3,204,439 | 9/1965 | Eads | 70/451 |
| 3,479,851 | 11/1969 | Davidson et al. | 70/451 |
| 3,503,234 | 3/1970 | Schultz | 70/451 |
| 3,651,673 | 3/1972 | Sendrowski et al. | 70/450 |
| 3,659,445 | 5/1972 | Eads et al. | 70/451 |
| 4,080,813 | 3/1978 | McKann | 70/450 |
| 4,505,504 | 3/1985 | Matzkin et al. | 292/337 |
| 4,989,428 | 2/1991 | Prevot | 70/451 X |

FOREIGN PATENT DOCUMENTS

| | | | |
|---|---|---|---|
| 2058708 | 6/1972 | Germany | 70/448 |
| 2425144 | 4/1975 | Germany | 70/448 |
| 9176 | 4/1906 | United Kingdom | 70/450 |

*Primary Examiner*—Suzanne Dino

*Attorney, Agent, or Firm*—Robert F. Palermo; Michael H. Minns

[57] ABSTRACT

A method is provided for attaching separable mounting tabs to a mortise lock housing, including the steps of providing a hollow mortise lock housing in the form of a rectangular parallelepiped with a first side adapted to lie in a door edge and to provide at least one opening for a bolt, providing one slot at each of top and bottom edges, as installed, of the first side of the lock housing, the slots providing narrow openings for capturing mounting tabs at top and bottom corners of the lock housing, providing two mounting tabs, each having a first end portion for mounting an end of the faceplate and a second end for capturable insertion in the slots in the lock housing, the tabs further having a substantially right angle bend between the first end and the second end, orienting the mounting tabs such that the first ends are substantially parallel to the first side of the lock housing and project above and below the top and bottom corners of the first side of the lock housing, respectively, and the second ends are substantially parallel to top and bottom sides of the lock housing, the right angle bends being aligned with the slots, inserting the mounting tabs into the slots to place the second ends thereof in contact with top and bottom sides of the lock housing and to engage means for preventing tipping of the tabs with the first side of the lock housing, and attaching the coverplate to the lock housing.

5 Claims, 2 Drawing Sheets

METHOD FOR ATTACHING FACEPLATE MOUNTING TABS TO A MORTISE LOCK HOUSING AND TABS AND HOUSINGS ADAPTED FOR THAT METHOD

This application is a continuation of application Ser. No. 08/507,734, filed Aug. 3, 1995 and now abandoned.

BACKGROUND OF THE INVENTION

This invention relates generally to door locks and mounting hardware and more particularly to faceplate mounting tabs and to the mortise lock housings upon which the mounting tabs are installed.

Generally, mortise locks provide the highest quality and security of commonly used locks. The sturdy lock housings provide stable alignment and protection for the lock components housed therein. Installation of these locks is, however, somewhat more involved than that of tubular or cylinder locks, since the door preparation cavity is much larger for the mortise locks. Once installed, mortise locks are very strong and durable, but assembly and installation, aside from preparation of the cavity, is often difficult and time consuming.

Attachment of the faceplate mounting tabs requires installation of screws to hold the tabs, extra care to align the tabs before tightening, and readjustment of alignment for attachment of the lock housing in the door edge and the faceplate to the housing. The mounting tabs must be aligned with the door edge, whether it is square or beveled, in order that the faceplate is flush. This sometimes requires several trial fits before proper alignment is attained, thereby raising installation costs, and it increases opportunity for improper alignment and other installation defects. If the tab screws are not adequately tightened by the installer, they may come loose in service, fall out, and cause rattling or even jamming of the lock mechanism.

The foregoing illustrates limitations known to exist in present mortise lock mounting schemes, and it would be advantageous to provide an alternative product or method for overcoming one or more of those limitations. Accordingly, a suitable alternative is provided including features more fully disclosed hereinafter.

SUMMARY OF THE INVENTION

In one aspect of the present invention, a method is provided for attaching separable mounting tabs to a mortise lock housing, comprising the steps of providing a hollow mortise lock housing in the form of a rectangular parallelepiped with a first side adapted to lie in a door edge and to provide at least one opening for a bolt; providing one slot at each of top and bottom edges, as installed, of the first side of said lock housing, said slots providing narrow openings for capturing mounting tabs at top and bottom corners of said lock housing; providing two mounting tabs, each having a first end portion for mounting an end of the faceplate and a second end portion for capturable insertion in the slots in the lock housing, the tabs further having a substantially right angle bend between the first end and the second end; orienting the mounting tabs such that the first ends are substantially parallel to the first side of the lock housing and project above and below the top and bottom corners of the first side of the lock housing, respectively, and the second ends are substantially parallel to top and bottom sides of the lock housing, the right angle bends being aligned with the slots; inserting the mounting tabs into the slots to place the second ends thereof in contact with top and bottom sides of the lock housing and to engage, with the first side of the lock housing, means for preventing tipping of the tabs; and attaching the coverplate to the lock housing.

The foregoing and other aspects of the invention will become apparent from the following detailed description, when considered in conjunction with the accompanying drawings.

DETAILED DESCRIPTION

Figure 1:
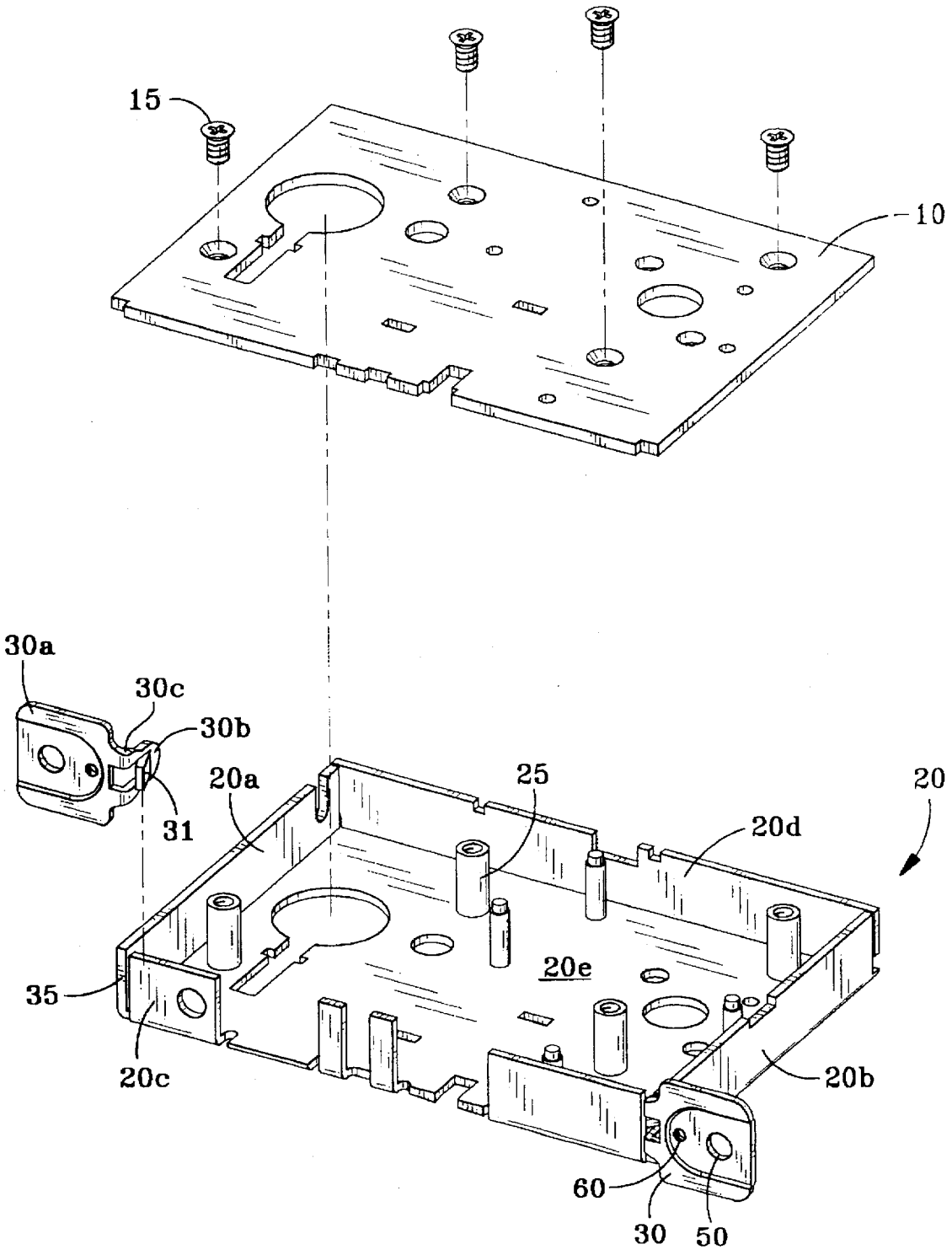
FIG. 1 is an exploded perspective view illustrating a mortise lock housing, a lid, and mounting tabs according to a preferred embodiment of the present invention.

FIG. 1 shows an exploded perspective view of a mortise lock housing with faceplate mounting tabs made according to the invention. For ease of description, reference will be made to features which are to be seen in at least one of FIGS. 1–3 and all figures should be referred to, as necessary. The lock housing is usually formed from a single piece of material as an open box having a rectangular parallelepiped shape, four sides 20*a*, 20*b*, 20*c*, 20*d*, and a bottom face 20*e*. A lid 10 fits over the open top face, and is secured by fasteners 15 attachable to lugs 25. At the corners where sides 20*a* and 20*b* abut side 20*c*, slots 35 are provided for inserting portions 30*c* (the corners) of faceplate mounting tabs 30 at the right-angle bends. When inserted, the first portion 30*a* of the tab 30 (which has a countersunk hole 50 and a threaded hole 60 for fastening the tab to the door edge and the faceplate to the door, respectively) is parallel to side 20*c* of the housing 20, and the second portion 30*b* lies within the housing and is parallel to sides 20*a* and 20*b*.

During assembly, tabs 30 are inserted edgewise into slots 35 as described, and when in place, are limited in their movement by spurs 31 which are formed in the second portions 30*b* of tabs 30 by slitting and bending a tab outward relative to the right-angle bend. When cover 10 is attached, the tabs are captured in place and have very limited freedom of movement; however, there is sufficient freedom of rotational movement to accommodate between square and beveled door edge installations. This movement also simplifies attachment of faceplates by assuring that, once attached to the door edge, the mounting tabs are parallel with the door edge, and the attachment screws of the faceplate will align with the threaded holes 60 of the tabs 30.

Figure 2:
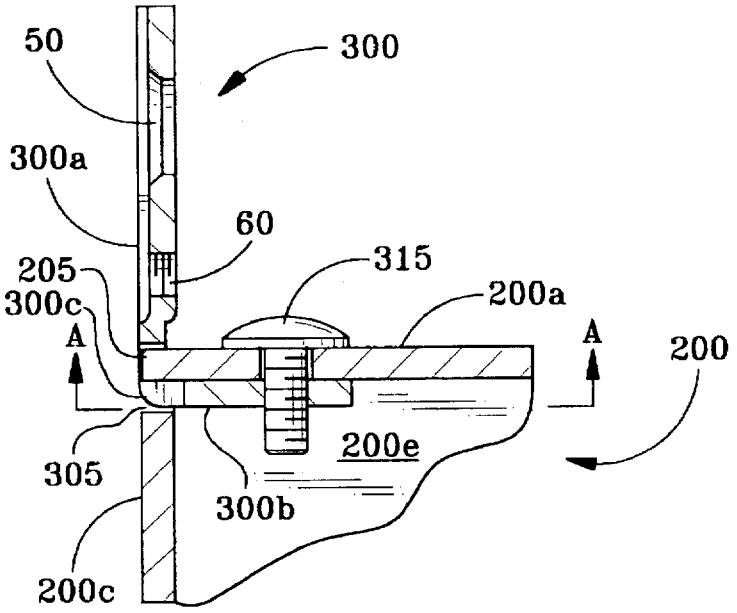
FIG. 2 (PRIOR ART)
FIG. 2 is a fragmentary sectional view of a corner of a lock housing illustrating the tab mounting system of the prior art.
Figure 2A:
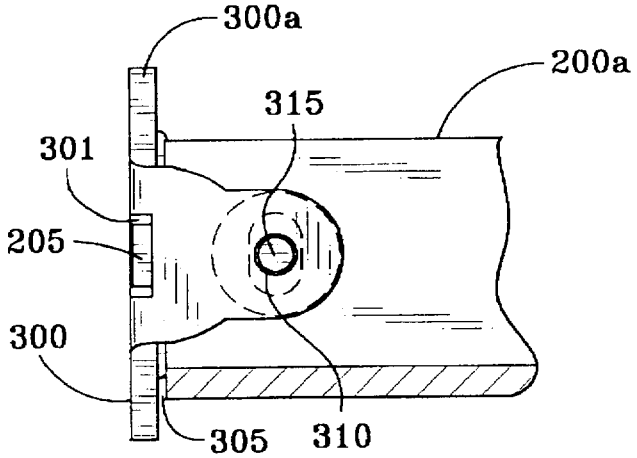
FIG. 2a (PRIOR ART)
FIG. 2*a* is a schematic plan view of a side of a lock housing in the direction of arrows "A—A" of FIG. 2.
Figure 3:
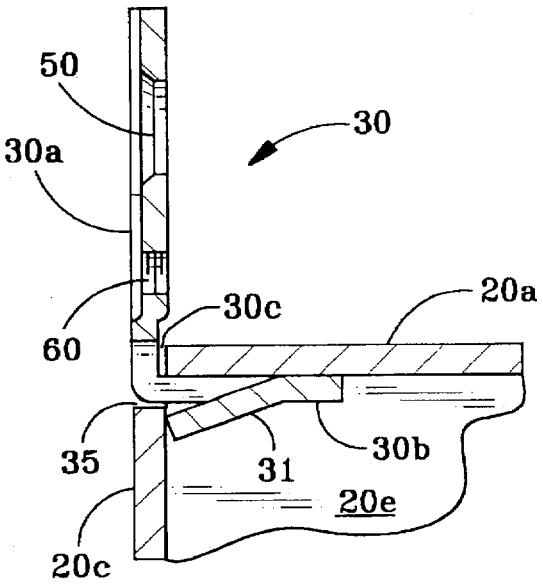
FIG. 3 is a fragmentary sectional view, similar to that in FIG. 2, illustrating the tab mounting system of a lock housing according to the present invention.

FIG. 2 shows the tab mounting system of the prior art, in which lock housing 200 is similar to housing 20 of FIGS. 1 and 3. Slot 305 at the corner between sides 200*a* and 200*c* is provided for inserting tab 300, except that a tab 205 on the end of side 200*a* interferes with complete seating of tab 300 and necessitates a slot 301 in the corner 300*c* of the tab. This slot allows proper placement of the tab on the housing as shown in the partial cutaway view in FIG. 2*a* along line "A—A" of FIG. 2. Except for the differences in the method of mounting the tabs on the housing, the tabs 300 of the prior art are functionally very similar to tabs 30 of the present invention. Thus, portions 300*a*, 300*b*, and 300*c* of the prior art tabs 300 are functionally similar to portions 30*a*, 30*b*, and 30*c* of tabs 30 of the invention. The prior art tab 300 is secured to the housing 200 by a screw 315 through side 200*a* into threaded hole 310 in portion 300*b* of the tab. That, together with the fit between tab 205 and slot 301 at the corner of the tab 300, securely fastens the tab to the housing. It is easily seen that any adjustment of the tab that is required in order for the tab to fit properly to the door edge will require removal of the housing from the cavity in the door, loosening the screws 315, aligning the tabs, retightening the screws, and re-insertion in the door to try again. The eventual accurate positioning of the tabs will be accomplished mostly by iteration and may take several attempts. This difficulty often causes installers to leave the screws 315 loose so that adjustments in alignment can be made without removal of the lock housing from the door. The un-tightened screws can work loose in service, fall out, and cause rattles and, more important, a loose lock housing which causes jamming and other malfunctions.

The tab mounting system of the present invention provides the advantages of ease of assembly and installation of the lockset and housing together with a saving on parts and labor costs. Moreover, it reduces the opportunity for errors in installation and results in a more reliable installation because of that reduction.

What is claimed is:

1. A method for attaching two separate mounting tabs to a mortise lock housing, comprising the following steps:

providing a hollow mortise lock housing in the form of a rectangular parallelepiped, one side of said housing comprising a removable coverplate, and a first side of said housing adapted to lie in a door edge and to provide at least one opening for a bolt;

providing one slot at each of top and bottom edges, as installed, of said first side of said lock housing, each said slot providing a narrow opening for capturing one of said separate mounting tabs at top and bottom corners of said lock housing, each slot being open at one end when said coverplate is removed;

providing said two separate mounting tabs, each tab having a first end portion for mounting the tab to said door edge and a second end portion having engagement means thereon for engaging an interior surface of said first side of said lock housing to limit movement of the tab relative to said first side, each said tab further having a substantially right angle bend between said first end portion and said second end portion;

assembling said mounting tabs to said lock housing while said coverplate is removed, by orienting said mounting tabs such that said first end portions are substantially parallel to the first side of the lock housing and project above and below the top and bottom corners, respectively, of said first side of said lock housing, and said second end portions are substantially parallel to top and bottom sides, respectively, of said lock housing, each of said right angle bends being aligned with a respective one of the slots; and, inserting said mounting tabs into said open ends of said slots to place the second ends of said tabs in contact with top and bottom sides, respectively, of said lock housing and to engage said engagement means with said interior surface of said first side of said housing to prevent tipping of said tabs with respect to said first side of said housing; and attaching said coverplate to said lock housing.

2. A separable door lock mounting tab for use with another identical mounting tab to mount a mortise lock housing in a door edge, said lock housing comprising a hollow rectangular box with a removable coverplate, means for mounting said coverplate on said box, and a first side having a passage for a bolt and abutting said door edge, said box having a top slot and a bottom slot at top and bottom edges, respectively, of said first side, said top and bottom slots being adjacent a top side and a bottom side, respectively, of said box, said mounting tab comprising:

a substantially rigid strip of material having a first end, a second end, and a substantially right-angle bend between said first and second ends;

said first end having means for attaching said mounting tab to said door edge and means for attaching a faceplate to said tab; and said second end having means thereon for:

engaging an interior surface of said first side when said mounting tab is installed in one of said top and bottom slots with said second end adjacent either one of the top and bottom sides of said box, preventing removal of said mounting tab through the slot in which it is mounted, and limiting rotational movement of said second end away from said one of the top and bottom sides.

3. The separable door lock mounting tab of claim 2, wherein the means for attaching said mounting tab to said door edge comprises a hole in said first end for a threaded fastener.

4. The separable door lock mounting tab of claim 2, wherein the means for attaching a faceplate to said tab comprises a threaded hole in said tab for receiving a threaded fastener from said faceplate.

5. The separable door lock mounting tab of claim 2, wherein said engagement means comprises a portion of said second end of said mounting tab which is offset adjacent said right-angle bend, said offset portion lying against said inside surface of said first side of said lock housing to substantially prevent movement of said tab.

* * * * *